US008875836B2

(12) United States Patent
Park et al.

(10) Patent No.: US 8,875,836 B2
(45) Date of Patent: Nov. 4, 2014

(54) TAIL PIPE FOR MUFFLER OF MOTOR VEHICLE

(71) Applicants: Hyundai Motor Company, Seoul (KR); Kia Motors Corporation, Seoul (KR)

(72) Inventors: Ki-Chul Park, Gyeonggi-do (KR); Ji-Heun Yook, Gyeonggi-do (KR); Jay Yon Jo, Gyeonggi-do (KR)

(73) Assignees: Hyundai Motor Company, Seoul (KR); Kia Motors Company, Seoul (KR)

( * ) Notice: Subject to any disclaimer, the term of this patent is extended or adjusted under 35 U.S.C. 154(b) by 0 days.

(21) Appl. No.: 14/030,236

(22) Filed: Sep. 18, 2013

(65) Prior Publication Data

US 2014/0158460 A1 Jun. 12, 2014

(30) Foreign Application Priority Data

Dec. 12, 2012 (KR) ..... 10-2012-0144822

(51) Int. Cl.
*F01N 13/08* (2010.01)

(52) U.S. Cl.
USPC ..... 181/227; 181/228

(58) Field of Classification Search
USPC ..... 181/227, 228
See application file for complete search history.

(56) References Cited

U.S. PATENT DOCUMENTS

| | | | | |
|---|---|---|---|---|
| 2,620,893 | A * | 12/1952 | Rountree et al. | 55/476 |
| 6,736,237 | B2 * | 5/2004 | Shaw et al. | 181/227 |
| 6,913,111 | B2 * | 7/2005 | Schorn et al. | 181/243 |
| 7,007,720 | B1 * | 3/2006 | Chase et al. | 138/110 |
| 8,312,961 | B2 * | 11/2012 | Won et al. | 181/227 |
| 2002/0053483 | A1 * | 5/2002 | Ebinger et al. | 181/227 |

FOREIGN PATENT DOCUMENTS

| | | |
|---|---|---|
| JP | 10-324163 | 12/1998 |
| JP | 4385322 B2 | 12/2009 |
| KR | 10-2012-0032369 | 4/2012 |

* cited by examiner

*Primary Examiner* — Forrest M Phillips
(74) *Attorney, Agent, or Firm* — Edwards Wildman Palmer LLP; Peter F. Corless

(57) ABSTRACT

A tail pipe for a muffler is provided that can improve aesthetical appearance of a rear surface of a vehicle, while preventing noise that is generated by air currents. The tail pipe may be a hollow tail pipe which is disposed at a rear end of a rear exhaust pipe connected to a rear end of the muffler, and which functions as an outlet adapted to discharge exhaust gas. The tail pipe may include: at least one panel forming an interior surface and an exterior surface opposite to the interior surface; a space surrounded by the panel and formed between the interior surface and the exterior surface; a receiving hole formed at the interior surface; and a barrier mounted in the space and partially protruded through the receiving hole, where the barrier collects soot from the exhaust gas.

19 Claims, 4 Drawing Sheets

TAIL PIPE FOR MUFFLER OF MOTOR VEHICLE

CROSS-REFERENCE TO RELATED APPLICATION

This application claims under 35 U.S.C. §119(a) priority to and the benefit of Korean Patent Application No. 10-2012-0144822 filed in the Korean Intellectual Property Office on Dec. 12, 2012, the entire contents of which are incorporated herein by reference.

BACKGROUND (a) Field of the Invention

The present invention relates to a tail pipe for a muffler of a motor vehicle. More particularly, the present invention relates to a tail pipe for a muffler that is configured to reduce exhaust noise generated by exhaust gas of the vehicle.

(b) Description of the Related Art

A silencer for a vehicle is commonly known as a "muffler," where the term "muffler" is used herein for convenience.

An explosive sound occurs by directly discharging exhaust gas of an engine of the vehicle to outside of a cylinder of the engine. Therefore, exhaust noise may be reduced by discharging exhaust gas via the muffler.

An expansion chamber typically is disposed in the muffler. The expansion chamber attenuates exhaust noise by using reflection of sound waves and resonance formed between walls mounted on an interior thereof. Otherwise, a method can be utilized by which a sound absorbing material is disposed in an exhaust pipe for decreasing acoustic energy by friction with sound waves. The expansion chamber may be arranged such that the exhaust pipe incorporates sound absorbing material.

An exhaust pipe typically is comprised of a front exhaust pipe connected to a front end of the expansion chamber and a rear exhaust pipe connected to a rear end of the expansion chamber. A tail pipe may be mounted on or formed at a rear end of the rear exhaust pipe. That is, the tail pipe serves as an outlet for exhaust gas.

If soot in the exhaust gas is deposited in the tail pipe, aesthetical appearance of the rear surface of the vehicle may be deteriorated. Recently, certain vehicles increasingly have used engines having high performance and high fuel consumption such as the gasoline direct injection engine (GDI engine) and the turbo gasoline direct injection engine (T-GDI engine). In addition, an amount of generated soot may be increased as the engine has greater performance and higher fuel consumption. In other words, the amount of generated soot is known to increase by using an engine having high performance and high fuel consumption such as those currently under development or in use.

Therefore, it is desirable to provide a tailpipe designed specifically for reducing the amount of generated soot while maintaining a pleasing aesthetical appearance of the rear surface of the vehicle simultaneously when an engine having high performance and high fuel consumption is used.

The above information disclosed in this Background section is only for enhancement of understanding of the background of the invention and therefore it may contain information that does not form the prior art that is already known in this country to a person of ordinary skill in the art.

SUMMARY

The present invention provides a tail pipe for a muffler of a motor vehicle having advantages of improving aesthetical appearance of a rear surface of the vehicle. Simultaneously, the present invention provides a tail pipe having further advantages of preventing noise that is generated by air current.

The tail pipe for a muffler of a motor vehicle according to an exemplary embodiment of the present invention preferably is a hollow tail pipe which is disposed at a rear end of a rear exhaust pipe connected to a rear end of the muffler and functions as an outlet adapted to discharge exhaust gas. The tail pipe may include: at least one panel forming an interior surface and an exterior surface opposite to the interior surface; a space surrounded by the panel and formed between the interior surface and the exterior surface; a receiving hole formed at the interior surface; and a barrier mounted in the space and partially protruded through the receiving hole. In addition, the barrier may collect soot from exhaust gas.

The tail pipe may further include an exhaust hole formed to face the ground at the exterior surface. The barrier may be formed as a porous body. The soot collected to the barrier may be absorbed into the inside of the barrier in a liquid state. The soot absorbed into the inside of the barrier may be held in the bather by surface tension.

The barrier may be formed as a porous body, and may absorb the collected soot into the inside of the barrier. The soot absorbed into the inside of the barrier may be held in the barrier by surface tension, and be discharged to the space by its own weight. The soot absorbed into the inside of the barrier may be discharged to the space if its weight overcomes the surface tension. The soot discharged to the space may be exhausted to an exterior of the tail pipe through the exhaust hole.

A cross-section of the hollow space may be formed to become gradually wider from the rear end of the rear exhaust pipe toward a direction that the exhaust gas is exhausted. The cross-section of the hollow space may be wider than a cross-section of an exhaust gas passage in the rear exhaust pipe. The part of the barrier protruded through the receiving hole may be disposed to be lower than the lowest portion of an interior surface of the rear exhaust pipe.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DETAILED DESCRIPTION OF THE EMBODIMENTS

An exemplary embodiment of the present invention will hereinafter be described in detail with reference to the accompanying drawings.

Figure 1:
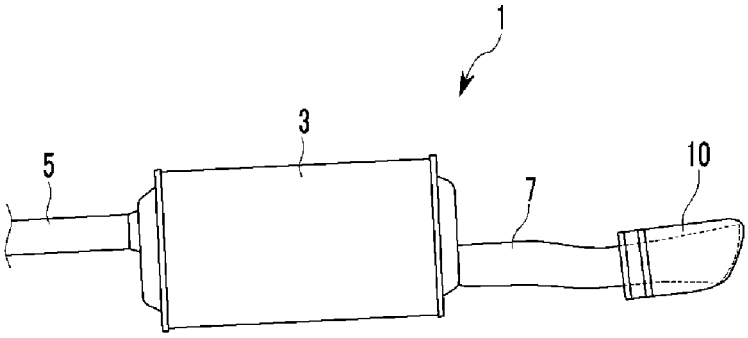
FIG. 1 is a schematic diagram of a muffler having a tail pipe according to an exemplary embodiment of the present invention.

FIG. 1 is a schematic diagram of a muffler having a tail pipe according to an exemplary embodiment of the present invention. As shown in FIG. 1, a tail pipe 10 for a muffler 1 according to an exemplary embodiment of the present invention is mounted at or integrally formed with the muffler 1. FIG. 1 is a side view of the muffler 1, and shows a composition of the muffler 1. The muffler 1 according to an exemplary embodiment of the present invention preferably includes an expansion device 3, a front exhaust pipe 5, a rear exhaust pipe 7, and the tail pipe 10.

The expansion device 3 is provided for attenuating exhaust noise of exhaust gas. In addition, the expansion device 3 can reduce back pressure of the exhaust gas. As used herein, the term "back pressure" refers to a pressure of an exhausted fluid.

An expansion chamber (not shown) is formed at or provided inside of the expansion device 3. As known to those skilled in the art, the expansion chamber of an expansion device attenuates exhaust noise by using reflection of sound waves and resonance formed between walls mounted on an interior thereof, and may include a space in which a sound absorbing material (not shown) is disposed for decreasing acoustic energy by friction with sound waves. The expansion chamber and the sound absorbing material are well known to a person of ordinary skill in the art such that a detailed description thereof will be omitted.

The front exhaust pipe 5 is provided to transfer exhaust gas exhausted from a combustion chamber of an engine. In addition, the front exhaust pipe 5 is connected to a front end of the expansion device 3.

The rear exhaust pipe 7 is provided to transfer the exhaust gas exhausted from the combustion chamber of the engine. In addition, the rear exhaust pipe 7 is connected to a rear end of the expansion device 3.

The tail pipe 10 is disposed so as to connect to a rear end of the rear exhaust pipe 7. That is, the tail pipe 10 serves as an outlet for the exhaust gas, and thus is provided to exhaust the exhaust gas to the atmosphere, i.e., outside of the tail pipe, and thus outside of the vehicle.

As used herein, the directions represented by the terms "front" and "rear" are determined with reference to the front direction and rear direction, respectively, of a vehicle. In particular, exhaust gas exhausted from a combustion chamber of an engine is exhausted to the atmosphere sequentially via the front exhaust pipe 5, the expansion device 3, the rear exhaust pipe 7, and the tail pipe 10.

Figure 4:
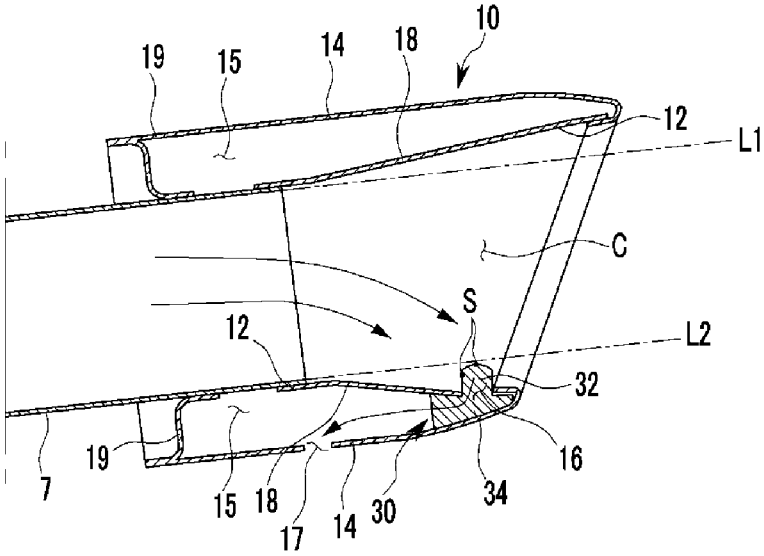
FIG. 4 is a cross-sectional view taken along a line A-A in FIG. 3.

Referring to FIG. 4, according to the present invention, exhaust gas can be exhausted via the tail pipe 10 such that exhaust noise and back pressure are reduced via the expansion device 3, which deposits soot S at the tail pipe 10, and then is exhausted to the atmosphere.

Figure 2:
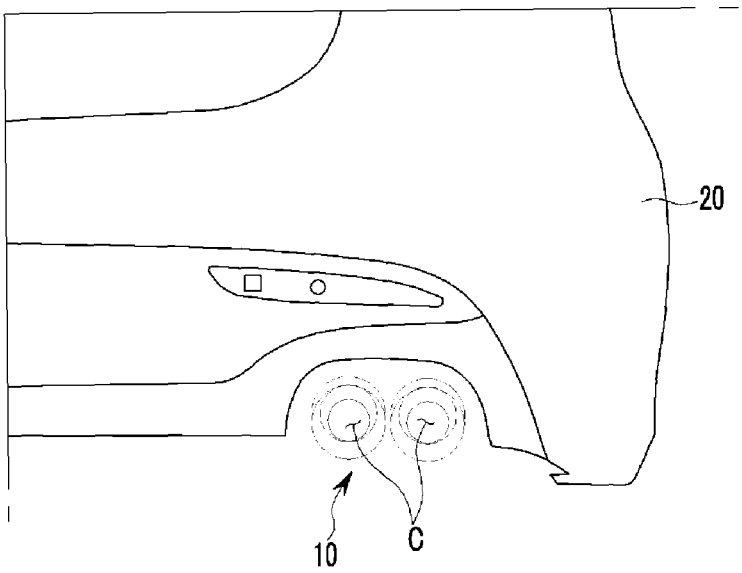
FIG. 2 shows that a tail pipe for a muffler according to an exemplary embodiment of the present invention as mounted to a vehicle.

FIG. 2 depicts a tail pipe for a muffler according to an exemplary embodiment of the present invention, where the tail pipe and muffler are mounted on a vehicle.

As shown in FIG. 2, the tail pipe 10 preferably is disposed at the lower side of a rear bumper 20 mounted on a rear surface of the vehicle. In addition, the tail pipe 10 is formed with a hollow pipe shape such that exhaust gas is configured to pass through the hollow space C thereof. In FIG. 2, although two tail pipes 10 are formed with a hollow cylindrical shape, the shape and the number of tail pipes are not limited thereto, and can be varied according to the knowledge of a person of ordinary skill in the art for improving functioning thereof. As provided herein, the tail pipe 10 refers to one or more tail pipes that can be formed with a hollow cylindrical shape.

The rear bumper 20 may be formed so as to provide a space for receiving the tail pipe 10 disposed at the rear end of the muffler 1 mounted on the lower surface of a vehicle body. The shape of the rear bumper 20 is not limited to the shape shown in FIG. 2.

Figure 3:
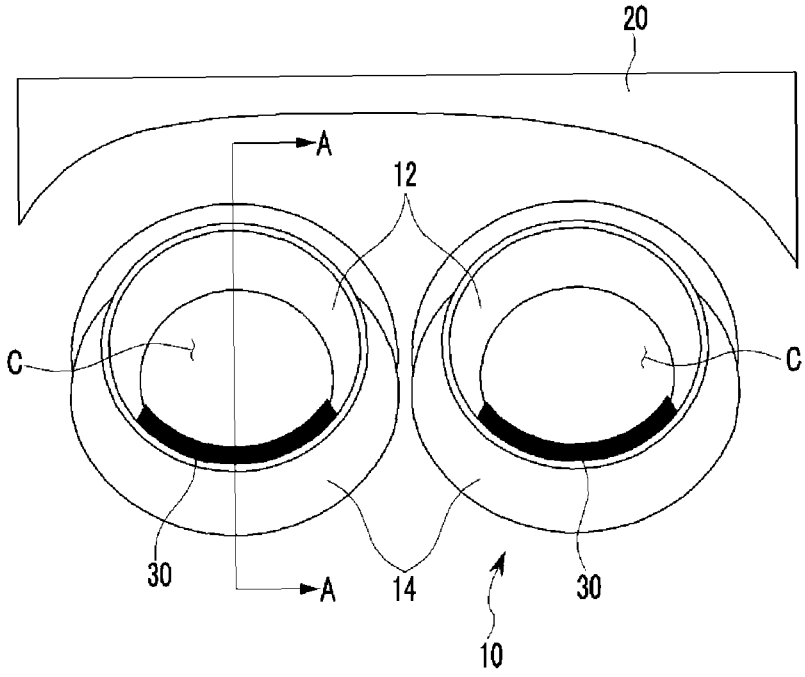
FIG. 3 is an enlarged view showing a portion of FIG. 2.

FIG. 3 is an enlarged view showing a portion of FIG. 2. As shown in FIG. 3, the tail pipe 10 includes an interior circumference 12 facing the hollow space C of the tail pipe 10 for passing the exhaust gas, an exterior circumference 14 on the opposite surface of the interior circumference 12, and a barrier 30.

The barrier 30 is partially protruded into the hollow space of the tail pipe 10 through the interior circumference 12. In addition, the barrier 30 is protruded through a part of the interior circumference 12 along a circumferential direction of the interior circumference 12. Further, the protruded part of the barrier 30 may be formed as an arc having a predetermined length on the interior circumference 12 formed toward an outside of the tail pipe 10, i.e., the atmosphere or ground.

FIG. 4 is a cross-sectional view taken along a line A-A in FIG. 3. As shown in FIG. 4, the tail pipe 10 further includes an interior space 15, a receiving hole 16, and an exhaust hole 17. In addition, the tail pipe 10 includes first and second panels 18 and 19. Further, the barrier 30 preferably includes a protrusion portion 32 and a supporting portion 34.

The interior space 15 is a space formed between the interior circumference 12 and the exterior circumference 14 of the tail pipe 10. In addition, an external shape of the tail pipe 10 is formed by the two panels 18 and 19 which are divided into the first panel 18 forming the interior circumference 12 and the second panel 19 forming the exterior circumference 14. Further, the interior space 15 is formed inside of the first and second panels 18 and 19 between the first and second panels 18 and 19. Preferably, at least one of the first and second panels 18 and 19 are contacted to and combined with the rear exhaust pipe 7. As provided herein, the tail pipe 10 and the rear exhaust pipe 7 may be integrally coupled with each other by welding, or alternatively, one of the tail pipe 10 and the rear exhaust pipe 7 may be inserted into the other one so as to be assembled with each other.

The receiving hole 16 is formed in the first panel 18. In particular, the receiving hole 16 is a hole formed such that the part of the barrier 30 protruded through the interior circumference 12 is able to penetrate the first panel 18, which part of the barrier 30 is the protrusion portion 32. That is, the barrier 30 shown in FIG. 3 includes the protrusion portion 32, and the features, shape of the barrier 30 mentioned in description about FIG. 3 make up the protrusion portion 32.

The supporting portion 34 is disposed in the interior space 15. In addition, the protrusion portion 32 is protruded from the supporting portion 34 and is extended into the hollow space C of the tail pipe 10. Further, the receiving hole 16 is formed near the rear end of the tail pipe 10, and the supporting portion 34 may be adhered to rear side as close as possible in the interior space 15 so as to be strongly mounted between the first and second panels 18 and 19. Thus, the supporting portion 34 is arranged to support the bather 30 for connection to the tail pipe 10. The protrusion portion 32 is inserted to the receiving hole 16 such that the barrier 30 can be further strongly mounted on the tail pipe 10.

As provided herein, the first panel 18 and the second panel 19 are coupled with each other after the protrusion portion 32 of the barrier 30 is inserted into the receiving hole 16 of the first panel 18. However, the number of panels is not limited to two panels, and additional panels may be used for making the tail pipe 10; also, the assembly method of the tail pipe 10 is not limited to that described herein, and the design can be varied as determined by a person of ordinary skill in the art.

The exhaust hole 17 is a hole which is formed for exhausting soot S to an exterior of the tail pipe 10. In addition, the exhaust hole 17 is formed in the second panel 19 and is configured to communicate with the interior space 15 and the exterior of the tail pipe 10. Further, the exhaust hole 17 is arranged to receive the soot S so as to exhaust it toward the outside or ground. That is, the exhaust hole 17 is formed at the lower portion of the exterior circumference 14 of the tail pipe 10.

As described above, exhaust gas deposits the soot S in the tail pipe 10, and the soot S then is exhausted to the atmosphere. In particular, the soot S is deposited near the rear end of the tail pipe 10 and the lower interior circumference 12. Meanwhile, ordinary conventional tail pipe has a problem that an aesthetical appearance of the rear surface of the vehicle may be deteriorated due to the deposited soot S being visibly exposed to an exterior of the tail pipe. However, according to an exemplary embodiment of the present invention, the soot S deposited in the tail pipe 10 is not exposed to the exterior of the tail pipe 10.

Hereinafter, a process for collecting and exhausting the soot S so as not to expose the soot S deposited in the tail pipe 10 will be described with reference to FIG. 4.

The barrier 30 preferably is formed with a cellular material. Further, the barrier 30 may be a porous metal. The cellular material preferably is a material which is formed as a porous body having many small gaps at the interior or the surface thereof, and the porous metal is a porous body which is formed by attaching and combining metal powder. For example, the porous body may be made of a material suitable for filtering soot. The porous body is well known to a person of ordinary skill in the art such that a detailed description thereof will be omitted.

In FIG. 4, it is shown that the soot S is deposited on the barrier 30. In particular, the barrier 30 is positioned on a same plane as the position of the lower interior circumference 12 that the soot S is deposited into. As a result, the barrier 30 collects the soot S from exhaust gas. In addition, the protrusion portion 32 of the barrier 30 is protruded into the hollow space C of the tail pipe 10 so as to catch the soot S moving toward the lower interior circumference 12 such that the soot S is effectively collected. Further, the soot S collected on the barrier 30 is not flowed down and is permeated into the inside of the barrier 30 through multiple holes of the barrier 30 because the barrier 30 is formed as the porous body. That is, the soot S is absorbed into the inside of the barrier 30 in a liquid state. The soot S may be in a liquid state when the soot S is collected on the surface of the barrier 30. In addition, the soot S may be liquefied by heat of exhaust such that the soot S is collected on the surface of the barrier 30.

The liquid soot S absorbed into the inside of the barrier 30 is held in the bather 30 by surface tension. However, if an amount of the liquid soot S absorbed into the inside of the barrier 30 is increased, a weight of the liquid soot S would be increased to overcome the surface tension thereof. Therefore, the liquid soot S is discharged from the barrier 30 into the interior space 15 of the tail pipe 10 by its own weight. Further, the liquid soot S discharged into the interior space 15 of the tail pipe 10 is exhausted to the exterior of the tail pipe 10 through the exhaust hole 17.

In FIG. 4, lines L1 and L2 that extend from the rear exhaust pipe 7 show that the interior diameter thereof is uniformly formed. An upper extended line L1 of the rear exhaust pipe 7 is an imaginary line which is extended from the uppermost portion of the interior circumference of the rear exhaust pipe 7 toward the rear along a length direction of the rear exhaust pipe 7. In addition, a lower extended line L2 of the rear exhaust pipe 7 is an imaginary line which is extended from the lowest portion of the interior circumference of the rear exhaust pipe 7 toward the rear along the length direction of the rear exhaust pipe 7. That is, distance between the upper extended line L1 and the lower extended line L2 is equal to the interior diameter of the rear exhaust pipe 7.

Meanwhile, the tail pipe 10 preferably is arranged such that the diameter of the interior circumference 12 becomes gradually wider from the portion combined with the rear exhaust pipe 7 toward the rear. That is, a cross-section of the hollow space C becomes gradually wider along a direction that the exhaust gas is exhausted. Preferably, the cross-section of the hollow space C is wider than cross-section of exhaust gas passage in the rear exhaust pipe 7. By this arrangement, it is possible to prevent flow velocity and back pressure of exhaust gas from being increased. In FIG. 4, it is shown that the interior circumference 12 is upwardly and downwardly spread toward the rear with respect to the upper and lower extended lines L1 and L2.

The protrusion portion 32 is disposed lower than the lower extended line L2. In addition, the height of the protrusion portion 32 may be lower than the lowest portion of the interior circumference of the rear exhaust pipe 7 with respect to the ground. Therefore, any interference can be minimized between the protrusion portion 32 and exhaust gas such that almost the entire flow of exhaust gas is performed along the upper and lower extended lines L1 and L2. That is, the design of the tail pipe 10 is such that noise generated by air current is substantially prevented.

According to an exemplary embodiment of the present invention, an aesthetical appearance of the rear surface of the vehicle is improved at least because the barrier 30 is disposed at the rear end of the tail pipe 10, and the soot S is exhausted to the exterior of the tail pipe 10 via the lower ends of the barrier 30 and the tail pipe 10. Further, noise generated by air current and back pressure is substantially prevented because of the manner in which the barrier 30 is disposed, which minimizes flow resistance of the exhaust gas.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A tail pipe for a muffler being hollow and disposed at a rear end of a rear exhaust pipe connected to a rear end of the muffler and which functions as an outlet for discharging exhaust gas, the tail pipe comprising:

at least one panel forming an interior surface and an exterior surface opposite to the interior surface;

a space surrounded by the at least one panel and formed between the interior surface and the exterior surface;

a receiving hole formed in the interior surface; and a bather mounted in the space and partially protruded through the receiving hole, wherein the barrier is configured to collect soot from the exhaust gas that passes through the tail pipe.

2. The tail pipe of claim 1, further comprising an exhaust hole arranged in the exterior surface and formed to face outside the tail pipe.

3. The tail pipe of claim 1, wherein the barrier is a porous body.

4. The tail pipe of claim 3, wherein the soot collected by the barrier is absorbed into the inside of the barrier in a liquid state.

5. The tail pipe of claim 4, wherein the soot absorbed into the inside of the barrier is held in the barrier by surface tension.

6. The tail pipe of claim 2, wherein the barrier is formed as a porous body, and absorbs the collected soot into the inside of the barrier.

7. The tail pipe of claim 6, wherein the soot absorbed into the inside of the barrier is held in the barrier by surface tension, and is discharged to the space.

8. The tail pipe of claim 7, wherein the soot absorbed into the inside of the barrier is discharged to the space if its weight overcomes the surface tension.

9. The tail pipe of claim 7, wherein the soot discharged to the space is exhausted to an exterior of the tail pipe through the exhaust hole.

10. The tail pipe of claim 1, wherein the barrier includes a protrusion portion and a supporting portion.

11. The tail pipe of claim 1, wherein a cross-section of the hollow space is formed to become gradually wider from the rear end of the rear exhaust pipe toward a direction that exhaust gas is exhausted.

12. The tail pipe of claim 11, wherein the cross-section of the hollow space is wider than a cross-section of an exhaust gas passage in the rear exhaust pipe.

13. The tail pipe of claim 11, wherein a part of the barrier protruded through the receiving hole is disposed to be positioned lower than a lowest portion of an interior surface of the rear exhaust pipe.

14. A tail pipe for a muffler, comprising:

at least one panel defining an interior surface of the tail pipe and an exterior surface opposite to the interior surface;

a space surrounded by the panel and formed between the interior surface and the exterior surface;

a receiving hole formed in the interior surface; and a barrier mounted in the space and at least partially protruded through the receiving hole, the barrier being configured to collect soot from exhaust gas that passes through the tail pipe, wherein the tail pipe is hollow and disposed at a rear end of a rear exhaust pipe connected to a rear end of the muffler.

15. The tail pipe of claim 14, further comprising an exhaust hole arranged in the exterior surface and formed to face outside the tail pipe.

16. The tail pipe of claim 14, wherein the soot collected by the barrier is absorbed into the inside of the barrier in a liquid state.

17. The tail pipe of claim 14, wherein the barrier includes a protrusion portion and a supporting portion.

18. The tail pipe of claim 14, wherein a part of the barrier protruded through the receiving hole is disposed to be positioned lower than a lowest portion of an interior surface of the rear exhaust pipe.

19. The tail pipe of claim 14, wherein the barrier is a porous body.

* * * * *